US009422123B2

(12) United States Patent
Maruta

(10) Patent No.: US 9,422,123 B2
(45) Date of Patent: Aug. 23, 2016

(54) SHEET CASSETTE, FEEDER, AND IMAGE FORMING APPARATUS

(71) Applicant: KYOCERA Document Solutions Inc., Osaka (JP)

(72) Inventor: Masaaki Maruta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/901,098

(22) PCT Filed: Jun. 15, 2015

(86) PCT No.: PCT/JP2015/067177

§ 371 (c)(1),
(2) Date: Dec. 28, 2015

(87) PCT Pub. No.: WO2015/194503

PCT Pub. Date: Dec. 23, 2015

(65) Prior Publication Data

US 2016/0145061 A1 May 26, 2016

(30) Foreign Application Priority Data

Jun. 20, 2014 (JP) ..... 2014-127149

(51) Int. Cl.
*B65H 1/26* (2006.01)
*B65H 1/04* (2006.01)

(52) U.S. Cl.
CPC ..... *B65H 1/266* (2013.01); *B65H 1/04* (2013.01); *B65H 2402/10* (2013.01); *B65H 2402/60* (2013.01); *B65H 2405/1122* (2013.01); *B65H 2405/1144* (2013.01); *B65H 2405/121* (2013.01)

(58) Field of Classification Search
CPC ..... B65H 1/04; B65H 1/266; B65H 2402/10; B65H 2402/60; B65H 2405/1122; B65H 2405/1144; B65H 2405/121
See application file for complete search history.

(56) References Cited

U.S. PATENT DOCUMENTS 5,537,195 A 7/1996 Sagara et al.
2008/0179818 A1* 7/2008 Hashimoto ..... B65H 1/266 271/145

(Continued)

FOREIGN PATENT DOCUMENTS

JP S58-100347 U 7/1983
JP 06-048591 A 2/1994

(Continued)

OTHER PUBLICATIONS

International Search Report and Written Opinion; issued in PCT/JP2015/067177; mailed Aug. 25, 2015.

*Primary Examiner* — Patrick Cicchino
(74) *Attorney, Agent, or Firm* — Studebaker & Brackett PC

(57) ABSTRACT

A sheet cassette (1) includes a first sheet accommodation section (3), a second sheet accommodation section (5), and a restricting section (7). The restricting section (7) includes a lever section (70), a first engagement section (38*a*), and a second engagement section (78*a*). The lever section (70) is shiftable between a first engaged position, a second engaged position, and a disengaged position. The first engaged position is a position where a distal end portion (76) protrudes from a sheet loading surface (F2) of a second bottom (50) with no sheets loaded on the second bottom (50), and the first engagement section (38*a*) and the second engagement section (78*a*) are in engagement. The second engaged position is a position where the distal end portion (76) is pushed down out of the first engaged position in accordance with the number of sheets loaded on the second bottom (50), and the first engagement section (38*a*) and the second engagement section (78*a*) are in engagement. The disengaged position is a position where the engagement between the first engagement section (38*a*) and the second engagement section (78*a*) is released. Strength of the engagement between the first engagement section (38*a*) and the second engagement section (78*a*) is larger when the lever section (70) is in the second engaged position than when the lever section (70) is in the first engaged position.

10 Claims, 11 Drawing Sheets

(56) References Cited

U.S. PATENT DOCUMENTS

| | | | | |
|---|---|---|---|---|
| 2009/0295073 | A1* | 12/2009 | Furusawa | B65H 1/266 271/171 |
| 2011/0129273 | A1* | 6/2011 | Jang | B65H 1/266 400/355 |
| 2012/0306144 | A1* | 12/2012 | Taki | B65H 31/36 271/3.14 |
| 2013/0341853 | A1* | 12/2013 | Hsu | B65H 1/00 271/145 |

FOREIGN PATENT DOCUMENTS

| | | | |
|---|---|---|---|
| JP | 08-301461 | A | 11/1996 |
| JP | 11-011697 | A | 1/1999 |
| JP | 2001-097561 | A | 4/2001 |
| JP | 2012-246090 | A | 12/2012 |

* cited by examiner

SHEET CASSETTE, FEEDER, AND IMAGE FORMING APPARATUS

TECHNICAL FIELD

The present invention relates to a sheet cassette in which a plurality of sheets are loaded, a feeder, and an image forming apparatus.

BACKGROUND ART

A sheet feed cassette disclosed in Patent Literature 1 includes a cassette main body and a cassette extendable section. The size of the sheet feed cassette is adjusted by sliding in and out the cassette extendable section according to the size of sheets.

The sheet feed cassette includes a lock mechanism. The lock mechanism includes an engagement hole and a lock button. The engagement hole is provided in the cassette main body. The lock button is provided in the cassette extendable section.

The lock button is in engagement with the engagement hole in a locked state. Pushing down the lock button releases the lock button from the engagement hole. Thus, the locked state of the cassette main body and the cassette extendable section is released. As a result, the cassette extendable section becomes slidable relative to the cassette main body.

CITATION LIST

Patent Literature

[Patent Literature 1]
Japanese Patent Application Laid-Open Publication No. 2001-97561

SUMMARY OF INVENTION

Technical Problem

However, the sheet feed cassette disclosed in Patent Literature 1 has the following problem. That is, since manipulating the lock button itself does not slide the cassette extendable section, a user is required to grab a certain part of the cassette extendable section and slide in or out the cassette extendable portion. Accordingly, manipulation of at least two parts is needed in order to release the locked state and slide in or out the cassette extendable section. Furthermore, once sheets are loaded, the locked state of the cassette main body (main cassette) and the cassette extendable section (sliding cassette) is generally required to be hard to release.

In view of the above-described problem, the present invention has been made to provide: a sheet cassette whose size is adjustable by simple manipulation and which is capable of restricting release of a locked state of a main cassette and a sliding cassette after loading of sheets; a feeder; and an image forming apparatus.

Solution to Problem

According to a first aspect of the present invention, a sheet cassette is to be loaded with a plurality of sheets and is adjustable in size. The sheet cassette includes a first sheet accommodation section, a second sheet accommodation section, and a restricting section. The first sheet accommodation section has a first bottom on which the plurality of sheets are loaded. The second sheet accommodation section has a second bottom on which the plurality of sheets are loaded. The second sheet accommodation section is attached to the first sheet accommodation section so as to be slidable between a retracted position where the second sheet accommodation section is retracted in the first sheet accommodation section and an extended position where the second sheet accommodation section is drawn out from the first sheet accommodation section in an extending direction. The restricting section restricts sliding of the second sheet accommodation section in the retracted position. The restricting section includes a lever section, a first engagement section, and a second engagement section. The lever section extends from the second bottom in the extending direction and has a distal end portion in the extending direction that is swingable in upward and downward directions. The first engagement section is disposed in the first bottom. The second engagement section is disposed in the lever section and is engageable with the first engagement section. The lever section is shiftable between a first engaged position, a second engaged position, and a disengaged position while the second sheet accommodation section is in the retracted position. The first engaged position is a position where no sheets are loaded on the second bottom, the distal end portion protrudes from a sheet loading surface of the second bottom, and the first engagement section and the second engagement section are in engagement. The second engaged position is a position where the distal end portion is pushed down out of the first engaged position in accordance with a number of sheets loaded on the second bottom, and the first engagement section and the second engagement section are in engagement. The disengaged position is a position where the lever section is lifted out of the first engaged position, and thus the engagement between the first engagement section and the second engagement section is released. Strength of the engagement between the first engagement section and the second engagement section is larger when the lever section is in the first engaged position than when the lever section is in the second engaged position.

According to a second aspect of the present invention, a feeder includes the sheet cassette according to the first aspect and a feeding section. The feeding section feeds a sheet from the sheets in the sheet cassette.

According to a third aspect of the present invention, an image forming apparatus includes the feeder according to the second aspect and an image forming section. The image forming section forms an image on the sheet fed by the feeder.

Advantageous Effects of Invention

According to the present invention, a user can slide the second sheet accommodation section by lifting the lever section to release the engagement, and subsequently pulling the lever section in a direction away from the first sheet accommodation section or pushing the lever section in a direction toward the first sheet accommodation section. That is, the releasing of the engagement and the sliding can be performed by a series of manipulation actions on the lever section. Once sheets are loaded, the distal end portion of the lever section is pushed down and the lever section is shifted from the first engaged position to the second engaged position. As a result, strength of the engagement between the first engagement section and the second engagement section is increased. It is therefore possible to adjust the size of the sheet cassette by simple manipulation and restrict release of a locked state of the main cassette and the sliding cassette after loading of sheets.

DESCRIPTION OF EMBODIMENTS

Figure 1:
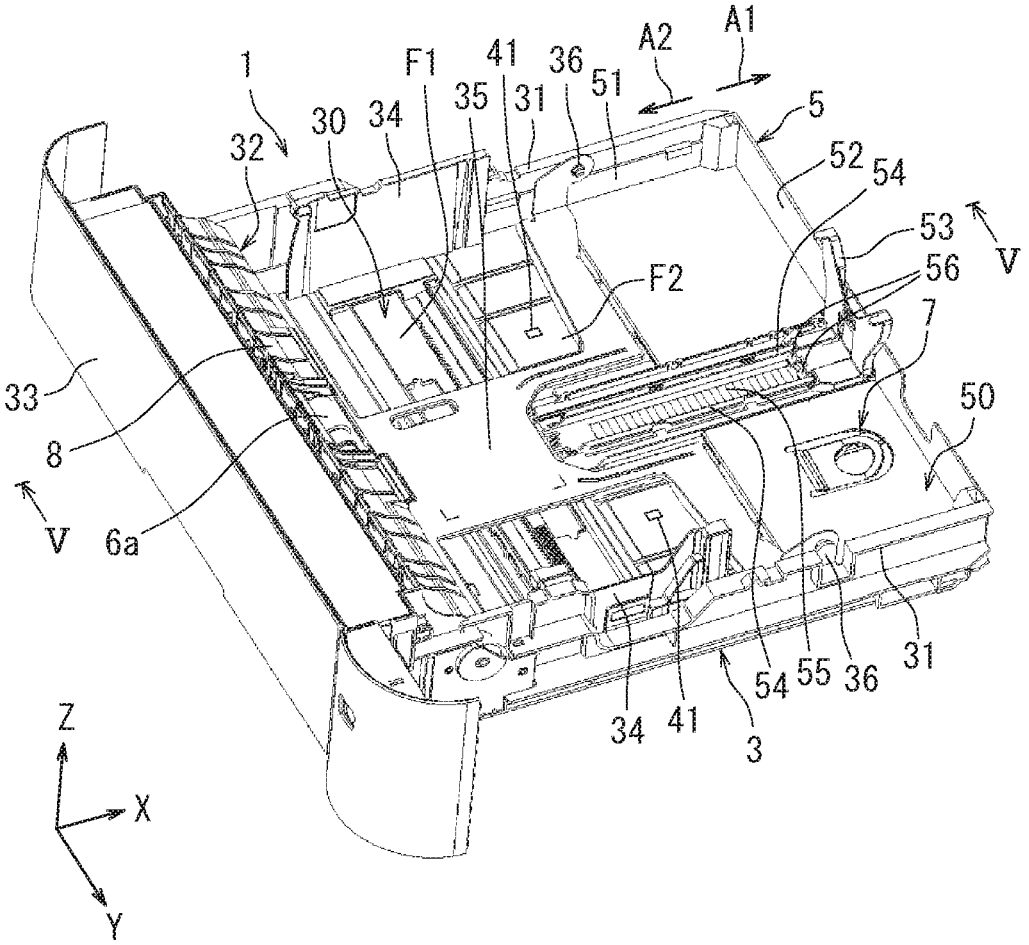
FIG. 1 is a perspective view of a sheet cassette according to a first embodiment of the present invention.

Hereinafter, embodiments of the present invention will be described with reference to the drawings. It should be noted that elements in the drawings that are the same or equivalent are labelled using the same reference signs and description thereof is not repeated.

First Embodiment

Basic Principle

The basic principle of a sheet cassette 1 according to the first embodiment of the present invention will be described with reference to FIGS. 1 to 6. FIG. 1 is a perspective view of the sheet cassette 1. A plurality of sheets (not shown) are loaded in the sheet cassette 1 which is adjustable in size. The sheet cassette 1 includes a main cassette 3 (first sheet accommodation section), a sliding cassette 5 (second sheet accommodation section), and a first restricting section 7 (restriction section). The main cassette 3 has a bottom member 30 (first bottom) on which a plurality of sheets are loaded. The bottom member 30 has a sheet loading surface F1.

The sliding cassette 5 has a bottom member 50 (second bottom) on which a plurality of sheets are loaded. The bottom member 50 has a sheet loading surface F2. The sliding cassette 5 is slidably attached to the main cassette 3. More specifically, the sliding cassette 5 is attached to the main cassette 3 so as to be slidable between a retracted position where the sliding cassette 5 is retracted in the main cassette 3 and an extended position where the sliding cassette 5 is drawn out from the main cassette 3 in a direction A1 away from the main cassette 3 (hereinafter, referred to as an "extending direction A1"). In FIG. 1, the sliding cassette 5 is in the retracted position. The restricting section 7 restricts sliding of the sliding cassette 5 in the retracted position.

Figure 2:
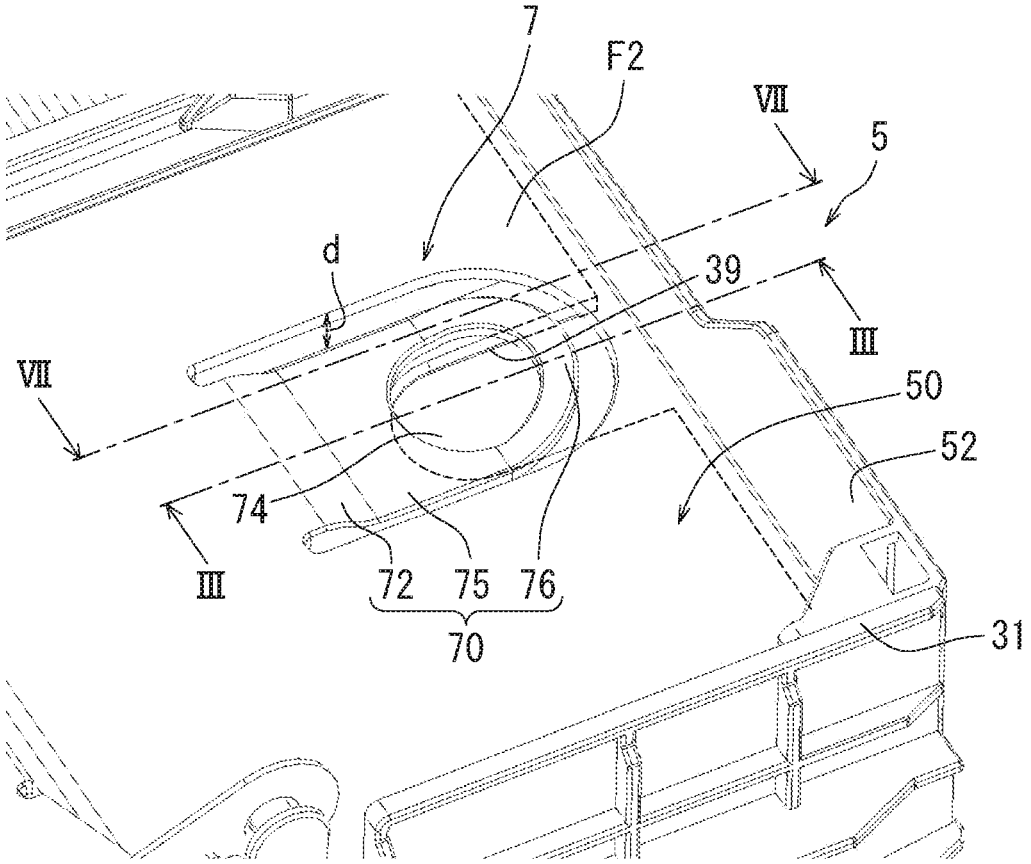
FIG. 2 is an enlarged perspective view of a first restricting section of the sheet cassette according to the first embodiment of the present invention.
Figure 3:
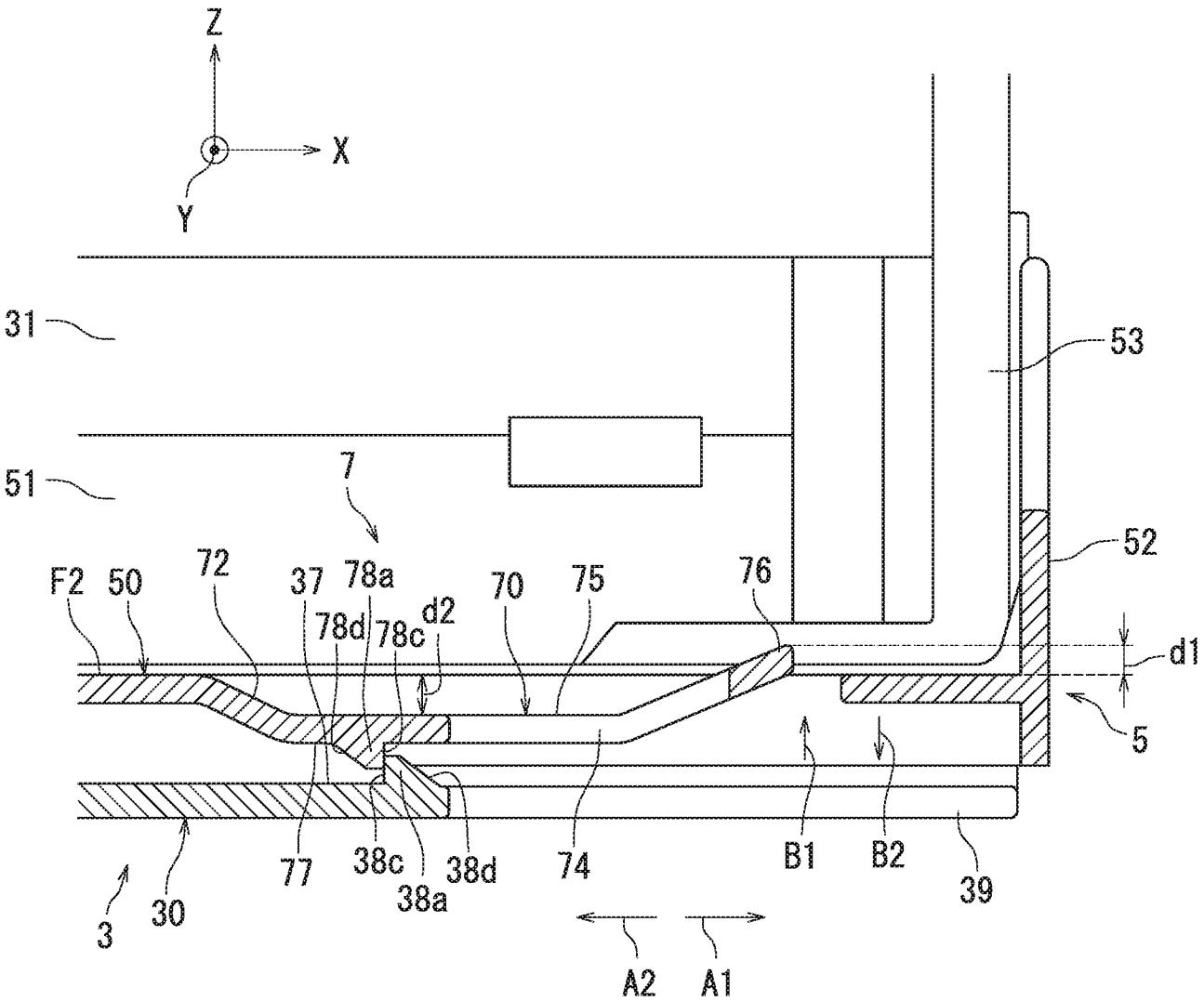
FIG. 3 is a cross-sectional view illustrating the first restricting section of the sheet cassette according to the first embodiment of the present invention (first engaged position).
Figure 4:
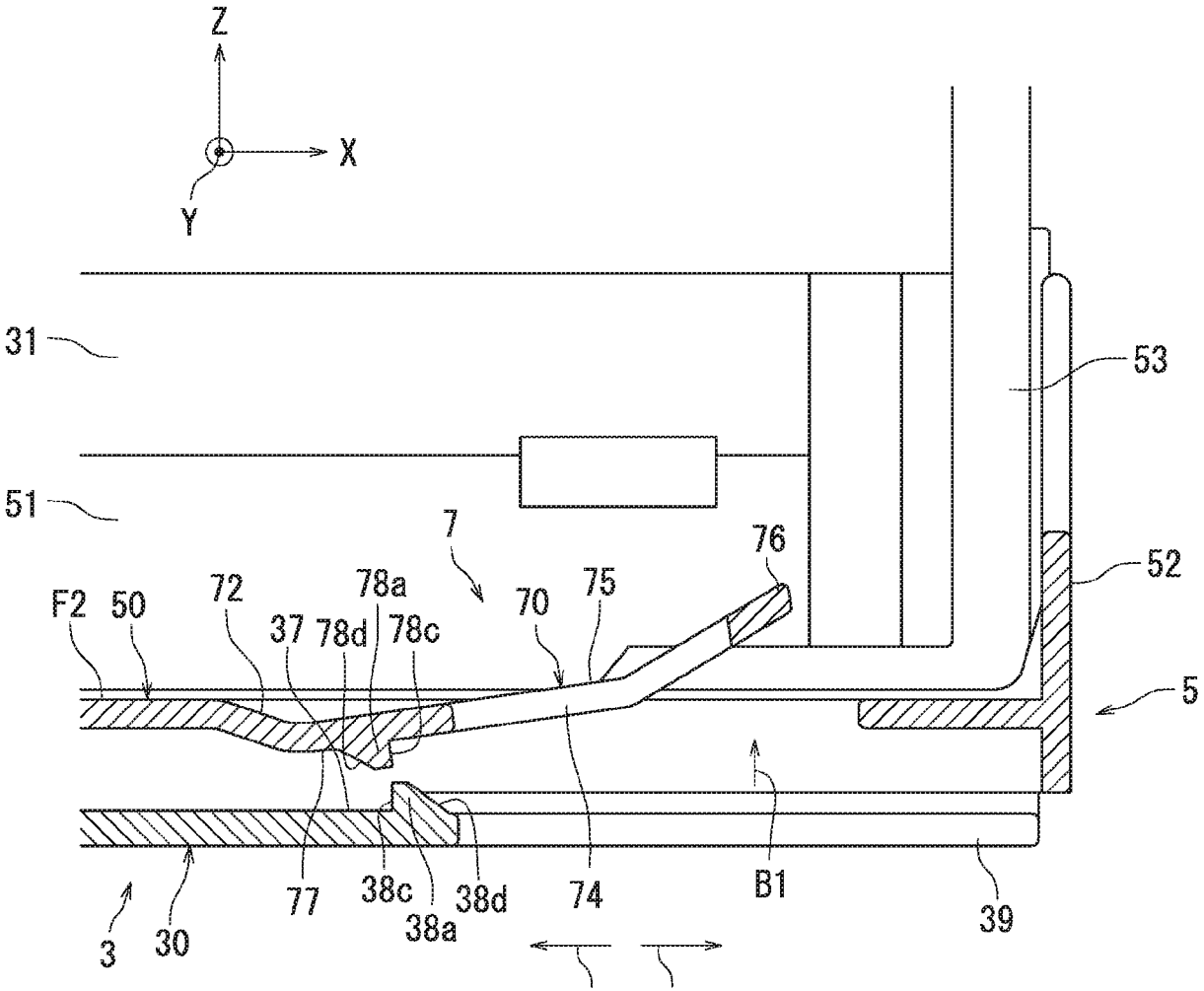
FIG. 4 is a cross-sectional view illustrating the first restricting section of the sheet cassette according to the first embodiment of the present invention (disengaged position).

FIG. 2 is an enlarged perspective view of the first restricting section 7 of the sheet cassette 1. FIG. 3 is a cross-sectional view illustrating an engaged state of the first restricting section 7, taken along line III-III in FIG. 2 (first engaged position). In FIG. 3, the sliding cassette 5 is in the retracted position. Furthermore, in FIG. 3, no sheets are loaded in the sheet cassette 1, and no external force is exerted on a projected portion 76. FIG. 4 is a cross-sectional view illustrating a disengaged state of the first restricting section 7 (disengaged position).

The first restricting section 7 includes an engagement pawl 38*a* (first engagement section), a lever section 70, and a mating engagement pawl 78*a* (second engagement section). The engagement pawl 38*a* is disposed in the bottom member 30 of the main cassette 3. The lever section 70 is disposed in the bottom member 50 of the sliding cassette 5. The lever section 70 extends from the bottom member 50 in the extending direction A1. The mating engagement pawl 78*a* is disposed in the lever section 70 and is engageable with the engagement pawl 38*a*. The engagement between the engagement pawl 38*a* and the mating engagement pawl 78*a* can be released by lifting the lever section 70.

The lever section 70 includes a proximal end portion 72, a lower portion 75, and the projected portion 76 (distal end portion). The proximal end portion 72 is connected with the bottom member 50. The lever section 70 starts from the proximal end portion 72 and extends in the extending direction A1. The lower portion 75 is formed continuous from the proximal end portion 72 and disposed lower than the sheet loading surface F2 of the bottom member 50. The projected portion 76 is the distal end portion of the lever section 70 in the extending direction A1. The projected portion 76 is formed continuous from the lower portion 75 and projected upward from the sheet loading surface F2. The proximal end portion 72 is elastic, and thus the projected portion 76 is swingable in upward and downward directions (in an upward direction B1 or in a downward direction B2).

The lever section 70 is shiftable from the first engaged position (FIG. 3) to the disengaged position (FIG. 4) when so manipulated. A second engaged position will be described later. As illustrated in FIG. 3, the first engaged position is a position where while the sliding cassette 5 is in the retracted position, no sheets are loaded on the bottom member 50, the projected portion 76 protrudes from the sheet loading surface F2 of the bottom member 50, and the engagement pawl 38*a* and the mating engagement pawl 78*a* are in engagement. Posture of the lever section 70 while in the first engaged position may be referred to as a first posture. As illustrated in FIG. 4, the disengaged position is a position where while the sliding cassette 5 is in the retracted position, the lever section 70 is lifted out of the first engaged position, and thus the engagement between the engagement pawl 38*a* and the mating engagement pawl 78*a* is released. Posture of the lever section 70 while in the disengaged position may be referred to as a third posture.

Shift of the lever section 70 from the first engaged position to the disengaged position releases the engagement between the engagement pawl 38*a* and the mating engagement pawl 78*a*, and allows the lever section 70 to be pulled in the extending direction A1 to slide the sliding cassette 5 and extend a size of the sheet cassette 1. As a result, the sliding cassette 5 is slid from the retracted position to the extended position.

That is, when the sliding cassette 5 is in the retracted position, it is possible to slide out the sliding cassette 5 up to the extended position by pulling the lever portion 70 in the extending direction A1 while the engagement between the engagement pawl 38*a* and the mating engagement pawl 78*a* is kept released by lifting the lever section 70, that is, while the lever section 70 is in the disengaged position.

Figure 5:
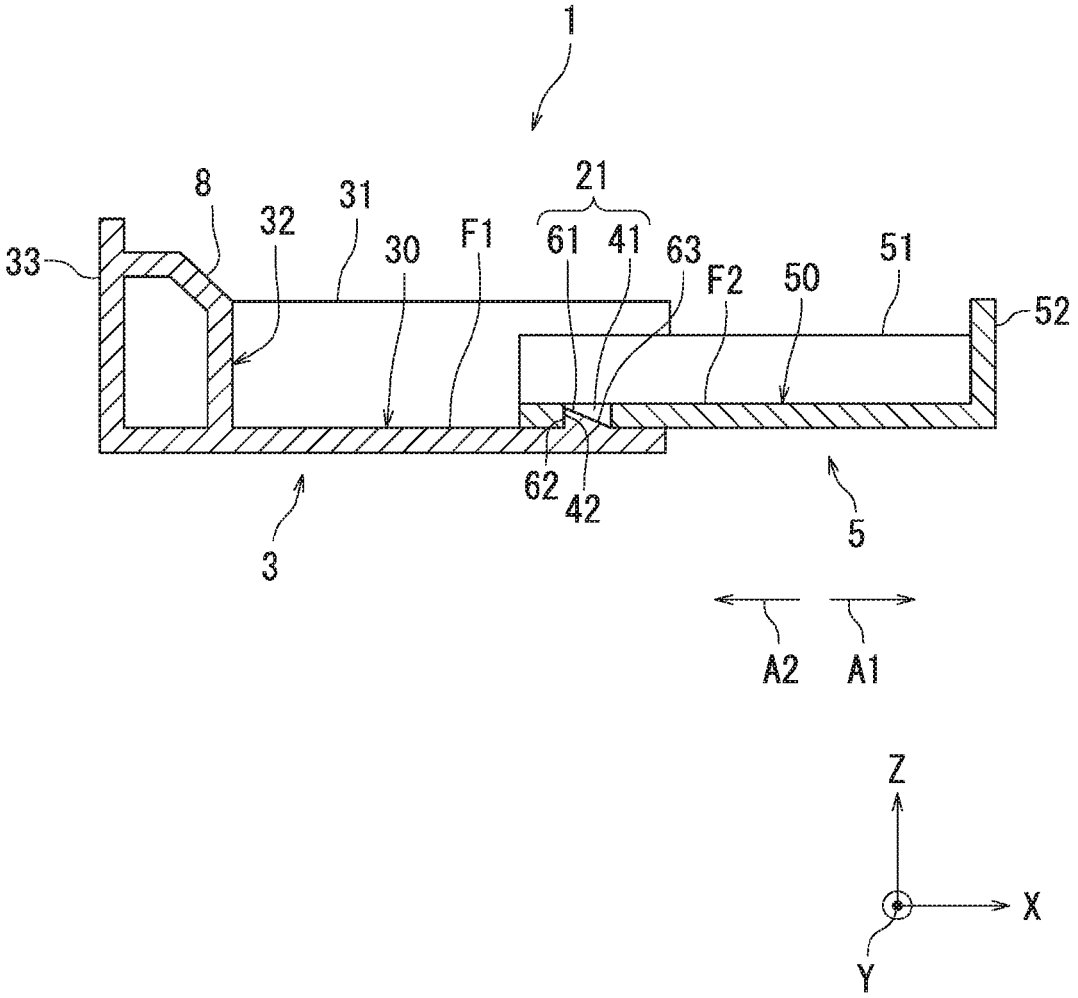
FIG. 5 is a cross-sectional view illustrating a second restricting section of the sheet cassette according to the first embodiment of the present invention.

FIG. 5 is a cross-sectional view illustrating a second restricting section 21 of the sheet cassette 1, taken along line V-V going through an engagement hole 41 illustrated in FIG. 1. In FIG. 5, the sliding cassette 5 is in the extended position. As illustrated in FIGS. 1 and 5, the sheet cassette 1 further includes the second restricting section 21. The second restricting section 21 restricts sliding of the sliding cassette 5 in the extended position.

The second restricting section 21 includes a pair of engagement holes 41 and a pair of engagement protrusions 61. The engagement holes 41 are through holes formed in the bottom member 50 of the sliding cassette 5. In the first embodiment, the engagement holes 41 are each rectangular and are formed in a region of the bottom member 50 that is closest to a forward end member 32.

The engagement protrusions 61 are formed in the bottom member 30 of the main cassette 3 so that the engagement protrusions 61 mate with the engagement holes 41 when the sliding cassette 5 is in the extended position. In the first embodiment, the engagement protrusions 61 are each formed in a region of the bottom member 30 that is closer to a rearward end member 52. The engagement protrusions 61 have a triangular cross-section and project from the sheet loading surface F1. The engagement protrusions 61 each have an engagement surface 62 and an inclined surface 63. The inclined surface 63 is inclined upward in a contracting direction A2 from the sheet loading surface F1. The contracting direction A2, which is opposite to the extending direction A1, is a direction in which the sliding cassette 5 moves toward the main cassette 3.

As the sliding cassette 5 is drawn out in the extending direction A1 into the extended position, each of the engagement protrusions 61 comes in engagement with the corresponding engagement hole 41. Specifically, the engagement surface 62 of the engagement protrusion 61 comes in engagement with an engagement surface 42 forming the engagement hole 41. As a result, sliding of the sliding cassette 5 in the extended position is restricted.

However, since the inclined surface 63 is inclined upward in the contracting direction A2, merely pushing in the sliding cassette 5 in the contracting direction A2 can release the engagement (mating) between the engagement protrusions 61 and the engagement holes 41, and bring the sliding cassette 5 into the retracted position. Therefore, no special engagement (mating) releasing mechanism is needed in order to shift the sliding cassette 5 from the extended position to the retracted position.

As described with reference to FIG. 4, a user shifts the lever section 70 from the first engaged position to the disengaged position to release the engagement, and subsequently pulls the lever section 70 in the extending direction A1 or pushes the lever section 70 in the contracting direction A2 to slide in or out the sliding cassette 5. That is, the releasing of the engagement and the sliding can be performed by a series of manipulation actions on the lever section 70. Consequently, the size of the sheet cassette 1 can be adjusted by simple manipulation.

Figure 6:
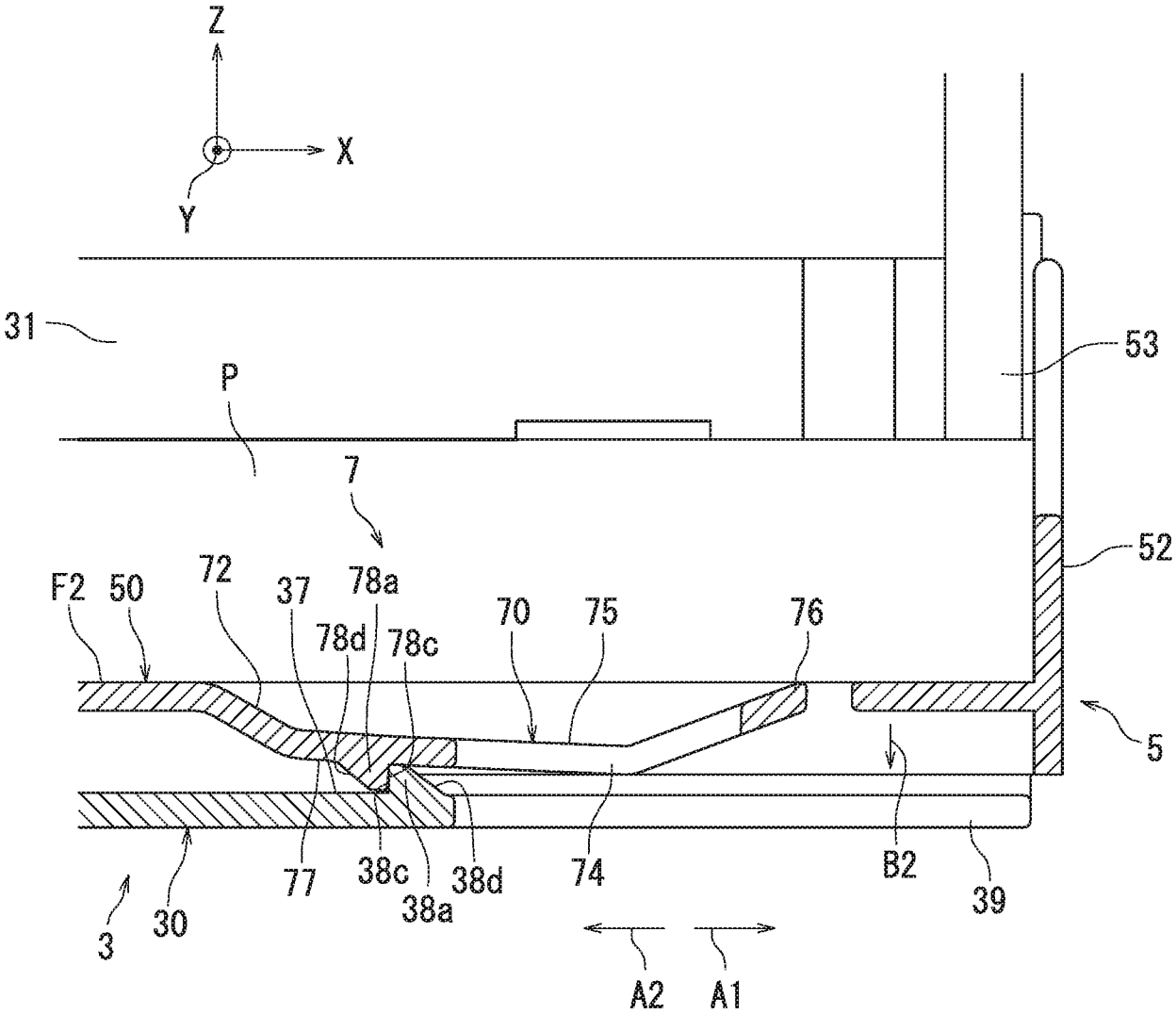
FIG. 6 is a cross-sectional view illustrating the first restricting section of the sheet cassette according to the first embodiment of the present invention (second engaged position).

FIG. 6 illustrates the engaged state of the first restricting section 7, during which the lever section 70 is in the second engaged position. In FIG. 6, a plurality of sheets P are loaded in the sheet cassette 1. The second engaged position is a position where while the sliding cassette 5 is in the retracted position, the projected portion 76 is pushed down out of the first engaged position in accordance with the number of sheets P loaded on the bottom member 50, and the engagement pawl 38*a* and the mating engagement pawl 78*a* are in engagement. Posture of the lever section 70 in the second engaged position may be referred to as a second posture. Strength of the engagement between the engagement pawl 38*a* and the mating engagement pawl 78*a* is larger when the lever section 70 is in the second engaged position than when the lever section 70 is in the first engaged position. FIG. 6 illustrates a situation in which the projected portion 76 is retracted below the sheet loading surface F2 and the engagement strength is at its maximum.

Since the lever section 70 is shifted from the first engaged position to the second engaged position by the projected portion 76 pushed down due to loading of the sheets P, the strength of the engagement between the engagement pawl 38*a* and the mating engagement pawl 78*a* is increased. As a result, the locked state of the main cassette 3 and the sliding cassette 5 can be prevented from being released after loading of the sheets P.

As described with reference to FIGS. 3, 4, and 6, the lever section 70 is shiftable between the first engaged position (FIG. 3), the second engaged position (FIG. 6), and the disengaged position (FIG. 4) while the sliding cassette 5 is in the retracted position.

[General Configuration of Sheet Cassette 1]

General configuration of the sheet cassette 1 will be described with reference to FIG. 1. In the first embodiment, an X axis and a Y axis are horizontal axes perpendicular to one another, and a Z axis is a vertical axis. The extending direction A1 and the contracting direction A2 are substantially parallel to the X axis. A sheet conveyance direction in the sheet cassette 1 is substantially the same as the contracting direction A2, and a direction opposite to the sheet conveyance direction is substantially the same as the extending direction A1. In embodiments of the present invention, a "forward end" or a "forward end portion" of a member or section refers to a forward end or a forward end portion of the member or section in the contracting direction A2, that is, a forward end or a forward end portion of the member or section in the sheet conveyance direction. A "rearward end" or a "rearward end portion" of a member or section refers to a rearward end or a rearward end portion of the member or section in the contracting direction A2, that is, a rearward end or a rearward end portion of the member or section in the sheet conveyance direction. A positive direction of the Z axis is the upward direction B1, and a negative direction of the Z axis is the downward direction B2 (see FIG. 3). FIG. 1 illustrates the sheet cassette 1 in a minimum size state with the sliding cassette 5 pushed in the contracting direction A2 to the maximum.

The sliding cassette 5 is slidable in the extending direction A1 relative to the main cassette 3. Sliding the sliding cassette 5 in the extending direction A1 therefore extends the size of the sheet cassette 1, allowing larger-sized sheets P to be loaded in the sheet cassette 1. The sliding cassette 5 is slidable also in the contracting direction A2 relative to the main cassette 3. Sliding the sliding cassette 5 in the contracting direction A2 therefore contracts the size of the sheet cassette 1, allowing smaller-sized sheets P to be loaded in the sheet cassette 1. In the first embodiment, the sheet cassette 1 can be adjusted to a normal size with the sliding cassette 5 pushed in to the maximum and to an extended size with the sliding cassette 5 drawn out to the maximum. The extended size defines a maximum size of sheets P that can be loaded in the sheet cassette 1.

The main cassette 3 is formed mainly from a synthetic resin. Examples of the synthetic resin include acrylonitrile butadiene styrene (ABS) resins. The main cassette 3 includes the plate-like bottom member 30, a pair of side end members 31, the forward end member 32, a panel 33, a lift plate 35, a pair of shafts 36, and a pair of side end guides 34. The main cassette 3 is open at a rearward end thereof. The forward end member 32 is stood from the bottom member 30 and elongated along the Y axis. A sheet conveyance guide 8 and a retard roller 6*a* are disposed in the forward end member 32. The panel 33 is disposed on a front surface of the forward end member 32. The pair of side end members 31 are opposite to one another, stood from the bottom member 30, and elongated along the X axis.

The pair of shafts 36 are disposed corresponding to the pair of side end members 31. The lift plate 35 is disposed on the sheet loading surface F1 of the bottom member 30. Each side of a proximal end portion of the lift plate 35 has a supporting hole (not shown) through which the corresponding one of the shafts 36 penetrates. Each end of the proximal end portion of the lift plate 35 is rotatably supported by the shaft 36. Thus, a distal end portion of the lift plate 35 can be lifted up and down, rotating about the shafts 36.

The pair of side end guides 34 are disposed opposite to one another and corresponding to the pair of side end members 31. Each side end guide 34 is stood along the corresponding one of the side end members 31. The pair of side end guides 34 are connected with a rack-and-pinion mechanism (not shown). Accordingly, the pair of side end guides 34 are geared to one another and movable in directions toward one another or in directions away from one another along the Y axis.

The sliding cassette 5 is formed manly from a synthetic resin (for example, an ABS resin). The sliding cassette 5 includes the first restricting section 7, the plate-like bottom member 50, a pair of side end members 51, a rearward end member 52, a rearward end guide 53, a pair of rails 54, and a plurality of ratchet teeth 55. The first restricting section 7 is disposed in the bottom member 50. The sliding cassette 5 is open at a forward end thereof. The pair of side end members 31 are opposite to one another, stood from the bottom member 50, and elongated along the X axis. The rearward end member 52 is stood from the bottom member 30 and elongated along the Y axis.

The pair of rails 54 are formed on the bottom member 50 and elongated along the X axis. The plurality of ratchet teeth 55 are disposed between the pair of rails 54, along the X axis. The rearward end guide 53 is stood along the rearward end member 52. The rearward end guide 53 is movable along the rails 54. Engagement pawls 56 are formed in a lower part of the rearward end guide 53. The engagement pawls 56 can engage with the ratchet teeth 55 and disengage from the ratchet teeth 55. Thus, the rearward end guide 53 can be fixed at any location along the rails 54.

The sliding cassette 5 is attached to the main cassette 3 such that the bottom member 50 is disposed over the bottom member 30 in a region where the sliding cassette 5 overlaps the main cassette 3. The sheets P are stacked on one another in the positive direction of the Z axis over the sheet loading surface F1 of the bottom member 30, an upper surface of the lift plate 35, and the sheet loading surface F2 of the bottom member 50. More specifically, a forward end portion of the sheets P is placed over the sheet loading surface F1 and the upper surface of the lift plate 35, whereas a rearward end portion of the sheets P is placed over the sheet loading surface F2. The pair of side end guides 34 and the rearward end guide 53 are moved according to the size of the sheets P to be placed.

[Structure of Lever Section 70]

Structural detail of the lever section 70 will be described with reference to FIGS. 2 and 3. In FIGS. 2 and 3, the lever section 70 is in the first engaged position. The lever section 70 is formed integrally with the bottom member 50. The lever section 70 is plate-like. The lever section 70 is formed from an elastic material or formed to have elasticity. Thus, it is possible to easily form the lever section 70 that can be shifted upward and downward.

The lower portion 75 of the lever section 70 is located higher than the bottom member 30 and lower than the bottom member 50, and is substantially parallel to the bottom member 50 and to the bottom member 30. The projected portion 76 of the lever section 70 has a curved outer edge. The projected portion 76 is formed continuous from one end (more specifically, a rearward end) of the lower portion 75. The projected portion 76 is inclined relative to the lower portion 75 and projected in a diagonal upward direction from the lower portion 75 toward the extending direction A1. The projected portion 76 protrudes from the sheet loading surface F2 of the bottom member 50 by a distance d1.

The lever section 70 has a cylindrical through hole 74 to be caught by a finger of a user. The finger catches in the through hole 74 at a side thereof corresponding to the projected portion 76. More specifically, the through hole 74 is formed in the lever section 70 so as to span across the lower portion 75 and the projected portion 76. The through hole 74 penetrates through an upper surface and a lower surface of the lever section 70.

The lever section 70 has a second opposed region 77 that is opposed to a first opposed region 37 according to a position of the lever section 70. The lower surface of the lower portion 75 of the lever section 70 is the second opposed region 77. The mating engagement pawl 78*a* is formed in the second opposed region 77. It should be noted that the main cassette 3 has the first opposed region 37 that is opposed to the lever section 70 according to the position of the lever section 70. The engagement pawl 38*a* is formed in the first opposed region 37.

One end (more specifically, a rearward end) of the proximal end portion 72 is connected with the other end (more specifically, the forward end) of the lower portion 75. The other end (more specifically, a forward end) of the proximal end portion 72 is connected with the bottom member 50. The proximal end portion 72 is inclined downward from the bottom member 50 toward the lower portion 75. The lower portion 75 is therefore disposed at a position lower than the sheet loading surface F2 of the bottom member 50 by a distance d2.

[Shift of Lever Section 70]

Shift of the lever section 70 will be described with reference to FIGS. 3 and 4. As illustrated in FIG. 3, the lever section 70 is in the first engaged position while no sheets P are loaded in the sheet cassette 1 and no external force is exerted on the projected portion 76. As illustrated in FIG. 4, the lever section 70 is shifted from the first engaged position to the disengaged position when external force in the upward direction B1 is exerted on the projected portion 76 and thus the projected portion 76 is pulled up. That is, the lever section 70 is shifted to the disengaged position when no sheets P are loaded in the sheet cassette 1 and external force in the upward direction B1 is exerted on the projected portion 76.

More specifically, the projected portion 76 is a free end portion. Therefore, the external force shifts the lever section 70 in the upward direction B1 about the proximal end portion 72 from the first engaged position to the disengaged position. When the external force is released while the lever section 70 is in the disengaged position, the projected portion 76 is lowered due to the elasticity of the proximal end portion 72 such that the lever section 70 is shifted back to the first engaged position.

The user can put a finger in the through hole 74, catch the projected portion 76 with the finger, and pull up the projected portion 76 in the upward direction B1. As a result, the user can shift the lever section 70 into the disengaged position. The user can then release the finger from the lever section 70 or relax the force thereby to let the projected portion 76 move in the downward direction B2 so that the lever section 70 is shifted from the disengaged position back to the first engaged position.

[Structure of Engagement Pawl 38*a* and Mating Engagement Pawl 78*a*]

Structure of the engagement pawl 38*a* and the mating engagement pawl 78*a* will be described with reference to FIG. 3. The engagement pawl 38*a* projects from the bottom member 30 of the main cassette 3. More specifically, the engagement pawl 38*a* projects from the first opposed region 37. The engagement pawl 38*a* has an engagement surface 38*c* and an inclined surface 38*d*. The inclined surface 38*d* is on an opposite side of the engagement pawl 38*a* to the engagement surface 38*c*. The inclined surface 38*d* is inclined upward in the contracting direction A2 from the first opposed region 37.

The mating engagement pawl 78*a* projects from the lever section 70 of the sliding cassette 5. More specifically, the mating engagement pawl 78*a* projects from the second opposed region 77. The mating engagement pawl 78*a* has an engagement surface 78*c* and an inclined surface 78*d*. The inclined surface 78*d* is on an opposite side of the mating engagement pawl 78*a* to the engagement surface 78*c*. The inclined surface 78*d* is inclined downward in the extending direction A1 from the second opposed region 77.

[Restriction of Sliding of Sliding Cassette 5]

Restriction of the sliding of the sliding cassette 5 will be described with reference to FIGS. 3 and 6. First, restriction of the sliding when the lever section 70 is in the first engaged position will be described. While the lever section 70 is in the first engaged position at an engagement point, the engagement pawl 38*a* and the mating engagement pawl 78*a* are in engagement. The engagement point is where the engagement pawl 38*a* is opposite to the mating engagement pawl 78*a*. More specifically, the engagement surface 38*c* and the engagement surface 78*c* are in engagement. Accordingly, the sliding of the sliding cassette 5 in the extending direction A1 is restricted. The position of the sliding cassette 5 with the engagement pawl 38*a* and the mating engagement pawl 78*a* in engagement is a position where the sliding cassette 5 is pushed in the contracting direction A2 to the maximum, that is, the retracted position. Accordingly, the sliding cassette 5 is locked in a position where the size of the sheet cassette 1 is a minimum size.

Next, restriction of the sliding in a situation in which the sheets P are loaded in the sheet cassette 1 will be described. The lever section 70 is in the first engaged position before the sheets P are loaded in the sheet cassette 1. Once the sheets P are loaded in the sheet cassette 1, the projected portion 76 in contact with the sheets P receives the weight of the sheets P. The lever section 70 is therefore pushed down by the sheets P and shifted to the second engaged position. That is, the weight of the sheets P shifts the lever section 70 in the downward direction B2 about the proximal end portion 72 to the second engaged position. The distance of the shift of the lever section 70 can increase up to the distance d1 (see FIG. 3) with increase in the weight of the sheets loaded. Strength of the engagement between the engagement pawl 38*a* and the mating engagement pawl 78*a* therefore increases with increase in the weight of the sheets loaded. The strength of the engagement is increased for the following reason.

Generally, sheets loaded in a sheet cassette move in a sheet cassette moving direction when the sheet cassette is inserted into an image forming apparatus. The moving sheets are received by a rearward end and a rearward end guide of the sliding cassette. Consequently, a load according to the weight of the sheets is placed on the rearward end and the rearward end guide. In particular, in a situation in which many sheets are loaded or sheets having a larger size are loaded, the load on the rearward end and the rearward end guide is larger. As a result, the sliding cassette may be unintendedly unlocked.

In the first embodiment, shift of the lever section 70 to the second engaged position allows the strength of the engagement between the engagement pawl 38*a* and the mating engagement pawl 78*a* to increase with increase in the weight of the sheets loaded, preventing unlocking of the sliding cassette 5 due to a load resulting from the movement of the sheets P.

Once the projected portion 76 of the lever section 70 is shifted in the downward direction B2 by the distance d1, the sheets P become supported by the sheet loading surface F2 of the sliding cassette 5. Thus, the projected portion 76 is prevented from being further shifted in the downward direction B2 by more than the distance d1. As a result, deformation or damage that prevents the lever section 70 from returning to the first engaged position can be restricted.

[Removal of Restriction of Sliding of Sliding Cassette 5]

Removal of restriction of the sliding of the sliding cassette 5 will be described with reference to FIGS. 3 and 4. When external force in the upward direction B1 is exerted on the projected portion 76 of the lever section 70, and thus the lever section 70 is shifted from the position with the engagement pawl 38*a* and the mating engagement pawl 78*a* in engagement to the disengaged position, the mating engagement pawl 78*a* disengages from the engagement pawl 38*a* thereby to release the engagement therebetween. Thus, the restriction of the sliding of the sliding cassette 5 is removed. That is, the sliding cassette 5 is unlocked. When external force in the extending direction A1 is exerted on the lever section 70, the sliding cassette 5 slides in the extending direction A1. The sliding cassette 5 is drawn in the extending direction A1 to the maximum and locked by the second restricting section 21 in a position where the size of the sheet cassette 1 is a maximum size, that is, in the extended position.

A user for example extends the size of the sheet cassette 1 according to the following procedure. The user puts a finger in the through hole 74, catches the projected portion 76 of the lever section 70 with the finger, and pulls up the projected portion 76. As a result, the lever section 70 is shifted to the disengaged position, the engagement is released, and the restriction of the sliding is removed. Subsequently to the removal of the restriction of the sliding, the user catches a rear-side opening edge of the through hole 74 with a finger and pulls the finger in the extending direction A1. Consequently, the sliding cassette 5 can be drawn, and the size of the sheet cassette 1 can be extended. The sliding cassette 5 is drawn out by a prescribed distance, and stopped and locked by the second restricting section 21.

A user for example contracts the size of the sheet cassette 1 according to the following procedure. The user pushes in the sliding cassette 5 in the contracting direction A2 until the mating engagement pawl 78*a* comes in engagement with the engagement pawl 38*a*. Since the engagement pawl 38*a* has the inclined surface 38*d* and the mating engagement pawl 78*a* has the inclined surface 78*d*, the mating engagement pawl 78*a* can smoothly engage with the engagement pawl 38*a* as a result of the sliding of the sliding cassette 5 in the contracting direction A2.

[Structure of Cutout Portion 39]

A structure of the cutout portion 39 will be described with reference to FIGS. 2 and 3. The bottom member 30 of the main cassette 3 has the cutout portion 39. More specifically, the cutout portion 39 extends in the extending direction A1 from a specified location in the bottom member 30 to a rearward end of the bottom member 30. The cutout portion 39 is formed by cutting out a U-shaped portion from a rearward end portion of the bottom member 30. The cutout portion 39 is formed corresponding to a region of movement of the through hole 74 in accompaniment to the sliding of the sliding cassette 5. Accordingly, the through hole 74 moves above the cutout portion 39 in accompaniment to the sliding of the sliding cassette 5 in the extending direction A1 or in the contracting direction A2. As a result, the user can avoid contact of their finger with the bottom member 30 of the main cassette 3 and slide the sliding cassette 5 without pulling the finger out of the through hole 74. In the first embodiment, the cutout portion 39 is formed by cutting out a U-shaped portion from the rearward end portion of the bottom member 30.

According to the first embodiment, it is possible to adjust the size of the sheet cassette 1 by simple manipulation and restrict release of the locked state of the main cassette 3 and the sliding cassette 5 after loading of the sheets P as described above with reference to FIGS. 1 to 6.

Furthermore, according to the first embodiment, the engagement pawl 38*a* can be formed integrally with the main cassette 3, and the lever section 70 and the mating engagement pawl 78*a* can be formed integrally with the sliding cassette 5 as described with reference to FIGS. 2 and 3. It is therefore possible to form a mechanism for unlocking the sliding cassette 5 with a reduced number of elements.

Furthermore, according to the first embodiment, the engagement pawl 38*a* and the mating engagement pawl 78*a* allow the locking and the unlocking of the sliding cassette 5 to be readily performed as described with reference to FIGS. 3 and 4.

Furthermore, according to the first embodiment, the lever section 70 has the through hole 74 as described with reference to FIG. 2. Accordingly, a user can readily unlock the sliding cassette 5 by putting a finger in the through hole 74 and pulling up the lever section 70.

Second Embodiment

The sheet cassette 1 according to the second embodiment of the present invention will be described with reference to FIGS. 1, 2, and 7 to 9. Configuration of the sheet cassette 1 according to the second embodiment is the same as the configuration of the sheet cassette 1 according to the first embodiment except a part of the first restricting section 7. Therefore, the sheet cassette 1 illustrated in FIGS. 1 and 2 will be described as the sheet cassette 1 according to the second embodiment. Hereinafter, a difference between the second embodiment and the first embodiment will be mainly described.

Figure 7:
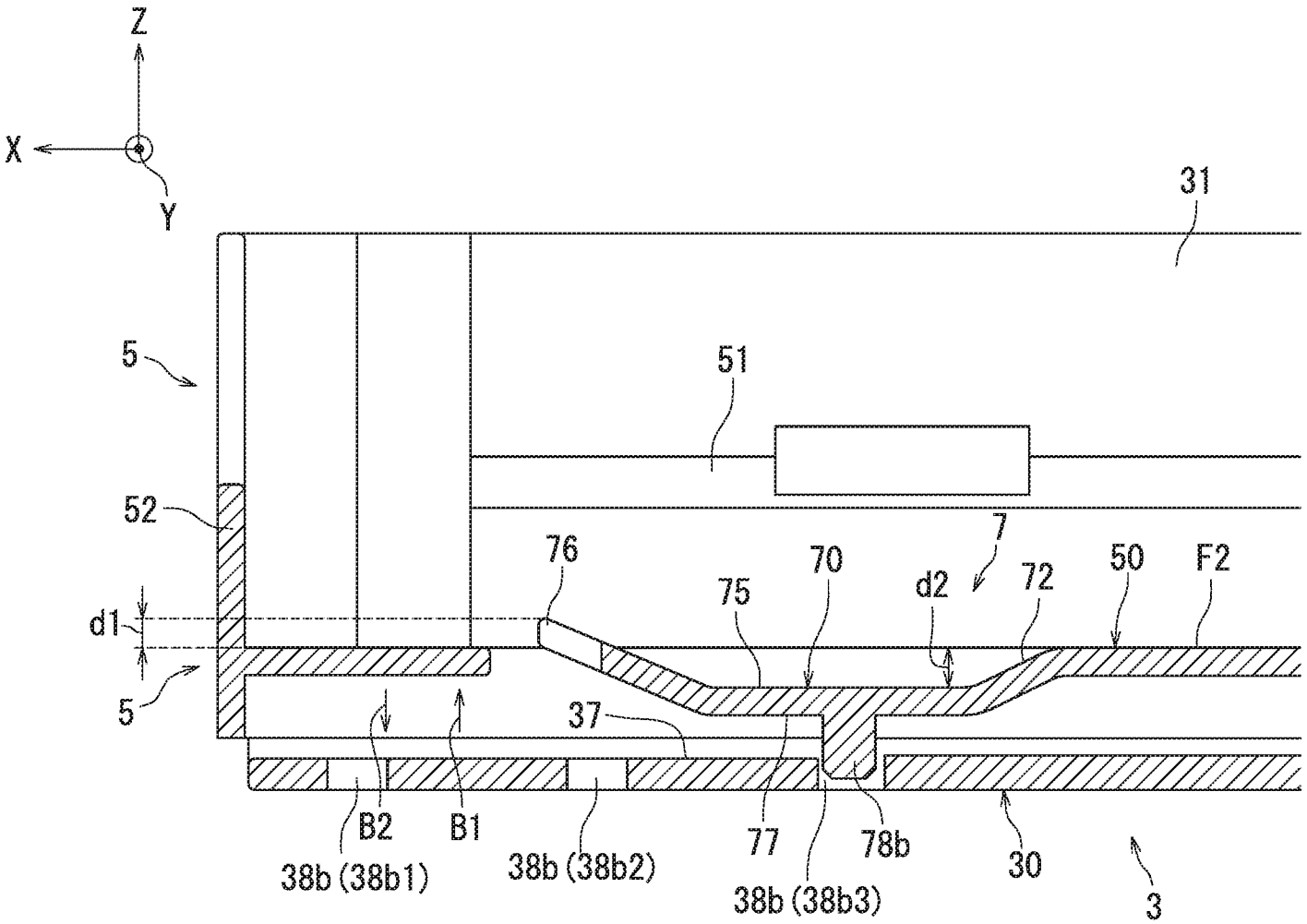
FIG. 7 is a cross-sectional view illustrating a first restricting section of a sheet cassette according to a second embodiment of the present invention (first engaged position).

FIG. 7 is a cross-sectional view taken along line VII-VII in FIG. 2, illustrating the engaged state of the first restricting section 7 in the sheet cassette 1 adjusted to a small size. In FIG. 7, the sliding cassette 5 is in the retracted position, and the lever section 70 is in the first engaged position. The first restricting section 7 (restricting section) includes a plurality of engagement holes 38*b* (a plurality of first engagement sections), the lever section 70, and an engagement protrusion 78*b* (second engagement section). In the second embodiment, the plurality of engagement holes 38*b* are provided instead of the engagement pawl 38*a* (see FIG. 3) of the first embodiment, and the engagement protrusion 78*b* is provided instead of the mating engagement pawl 78*a* (see FIG. 3) of the first embodiment.

The engagement holes 38*b* function as locking portions. The plurality of engagement holes 38*b* are three engagement holes 38*b* in the second embodiment. Of the three engagement holes 38*b*, an engagement hole 38*b* closest to the rearward end of the bottom member 30 may be referred to as an engagement hole 38*b*1, an engagement hole 38*b* adjacent to the engagement hole 38*b*1 may be referred to as an engagement hole 38*b*2, and an engagement hole 38*b* farthest from the rearward end of the bottom member 30 may be referred to as an engagement hole 38*b*3. The configuration of the lever section 70 is the same as the configuration of the lever section 70 of the first embodiment (see FIG. 3).

In the second embodiment, the first engaged position is a position where while the sliding cassette 5 is in the retracted position, no sheets are loaded on the bottom member 50, the projected portion 76 protrudes from the sheet loading surface F2 of the bottom member 50, and the engagement protrusion 78*b* is in engagement with one of the engagement holes 38*b*. The second engaged position is a position where while the sliding cassette 5 is in the retracted position, the projected portion 76 is pushed down out of the first engaged position in accordance with the number of sheets loaded on the bottom member 50, and the engagement hole 38*b* and the engagement protrusion 78*b* are in engagement. The disengaged position is a position where while the sliding cassette 5 is in the retracted position, the lever section 70 is lifted out of the first engaged position, and thus the engagement between the engagement hole 38*b* and the engagement protrusion 78*b* is released.

The plurality of engagement holes 38*b* are formed in the bottom member 30 of the main cassette 3. More specifically, the plurality of engagement holes 38*b* are formed in the first opposed region 37. In the second embodiment, each of the plurality of engagement holes 38*b* is a cylindrical through hole. Alternatively, each of the plurality of engagement holes 38*b* may be a bottomed recess. The plurality of engagement holes 38*b* are arranged along the extending direction A1.

Locations of the engagement holes 38*b* are determined according to a maximum size of sheets P that can be loaded in the sheet cassette 1 while the engagement protrusion 78*b* and one of the engagement holes 38*b* are in engagement. The engagement protrusion 78*b* protrudes from the lever section 70 of the sliding cassette 5. More specifically, the engagement protrusion 78*b* protrudes from the second opposed region 77. The engagement protrusion 78*b* has a cylindrical shape that can mate with each of the engagement holes 38*b*. The engagement holes 38*b* therefore have a slightly larger diameter than a diameter of the engagement protrusion 78*b*.

First, restriction of sliding by engagement (mating) between the engagement holes 38*b* and the engagement protrusion 78*b* when the lever section 70 is in the first engaged position will be described. While the lever section 70 is in the first engaged position at an engagement point, the engagement protrusion 78*b* is in engagement with one of the engagement holes 38*b*. The engagement point is where the one of the engagement holes 38*b* is opposite to the engagement protrusion 78*b*. More specifically, the engagement protrusion 78*b* is mating with one of the engagement holes 38*b*. Accordingly, the sliding of the sliding cassette 5 in the extending direction A1 and in the contracting direction A2 is restricted, and the sliding cassette 5 is locked. In the second embodiment, the term engagement and the term mating have the same meaning.

Figure 8:
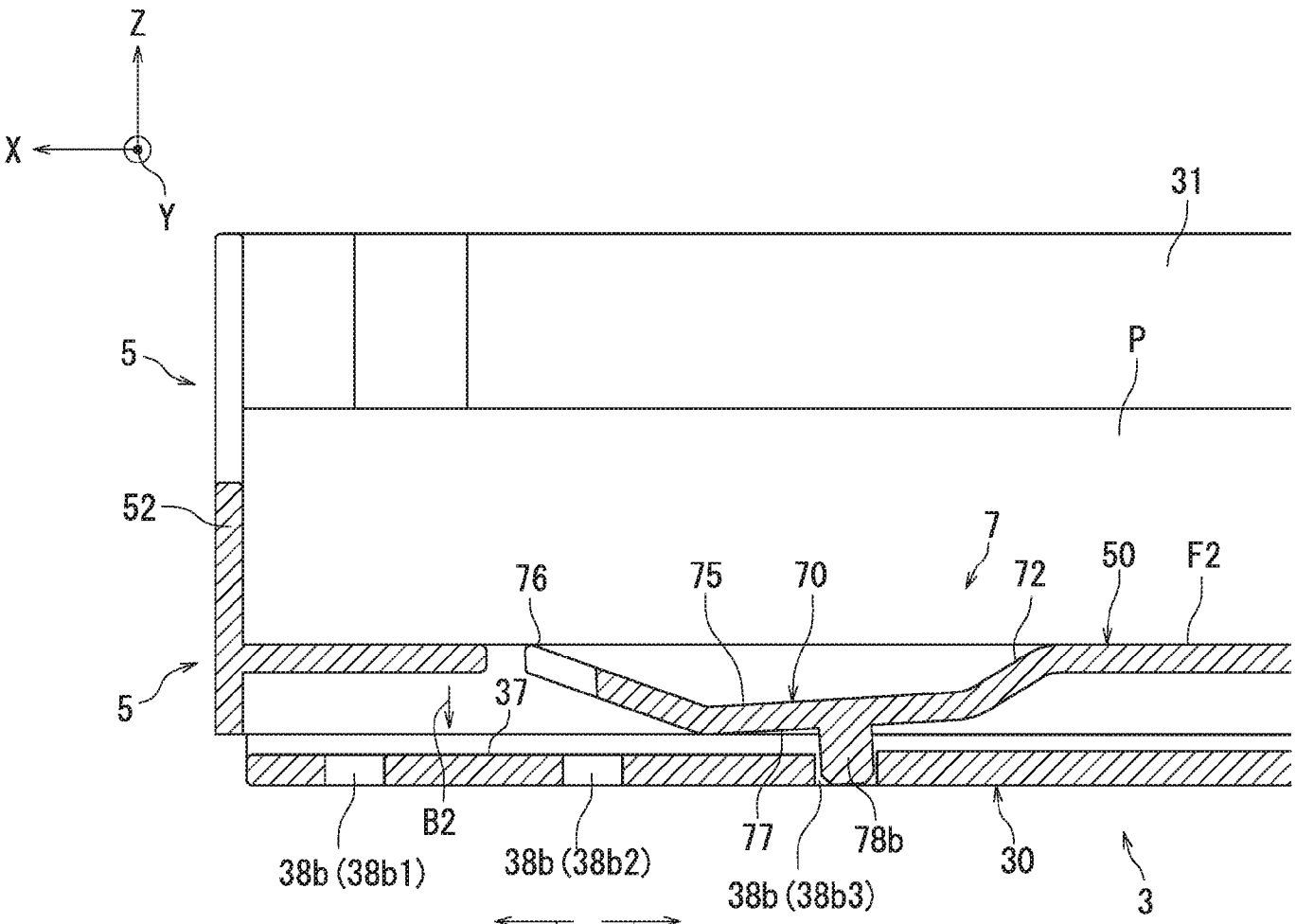
FIG. 8 is a cross-sectional view illustrating the first restricting section of the sheet cassette according to the second embodiment of the present invention (second engaged position).

Next, restriction of the sliding in a situation in which the sheets P are loaded in the sheet cassette 1 will be described. FIG. 8 illustrates a cross-section of the first restricting section 7 when the lever section 70 is in the second engaged position. In FIG. 8, a plurality of sheets P are loaded in the sheet cassette 1, and the sliding cassette 5 is in the retracted position.

As in the first embodiment, the projected portion 76 is pushed down by the weight of the sheets P, and the lever section 70 is shifted in the downward direction B2 about the proximal end portion 72 to the second engaged position. Strength of the engagement between the engagement hole 38*b* and the engagement protrusion 78*b* is larger when the lever section 70 is in the second engaged position than when the lever section 70 is in the first engaged position. FIG. 8 illustrates a situation in which the projected portion 76 is retracted below the sheet loading surface F2 and the engagement strength is at its maximum.

More specifically, the distance of the shift of the lever section 70 can increase up to the distance d1 (see FIG. 7) with increase in the weight of the sheets loaded. Thus, the engagement protrusion 78*b* mates with the engagement hole 38*b* more deeply when the lever section 70 is in the second engaged position than when the lever section 70 is in the first engaged position, and strength of the engagement between the engagement hole 38*b* and the engagement protrusion 78*b* increases with increase in the weight of the sheets loaded. As a result, as in the first embodiment, unlocking of the sliding cassette 5 due to a load resulting from the movement of the sheets P can be prevented. Since the projected portion 76 is not shifted downward by more than the distance d1 as in the first embodiment, deformation or damage that prevents the lever section 70 from returning to the first engaged position can be restricted.

Next, adjustment of the size of the sheet cassette 1 will be described. Since there are three engagement holes 38*b*1 to 38*b*3 in the second embodiment, the sheet cassette 1 is adjustable to three different sizes. The three different sizes are a large size, a medium size, and a small size. The sliding cassette 5 is in the retracted position when the sheet cassette 1 is in the small size, in the first extended position when in the medium size, and in the second extended position when in the large size.

The small size of the sheet cassette 1 will be described with reference to FIGS. 7 and 8. The engagement protrusion 78*b* is caused to mate with the engagement hole 38*b*3 by positioning the lever section 70 in the first engaged position or in the second engaged position. Accordingly, the sliding cassette 5 is in a position where the sliding cassette 5 is pushed in the contracting direction A2 to the maximum. As a result, the sliding cassette 5 is locked in a position where the sheet cassette 1 is in the small size.

Although not shown, the sliding cassette 5 is locked in a position where the sheet cassette 1 is in the medium size when the engagement protrusion 78*b* is mating with the engagement hole 38*b*2 and the sliding cassette 5 is locked in a position where the sheet cassette 1 is in the large size when the engagement protrusion 78*b* is mating with the engagement hole 38*b*1, with the lever section 70 in the first engaged position or in the second engaged position.

The second restricting section 21 (see FIGS. 1 and 5) in the second embodiment has a pair of engagement holes 41 and a pair of engagement protrusions 61 formed according to the position of the engagement hole 38*b*2, and another pair of engagement holes 41 and another pair of engagement protrusions 61 formed according to the position of the engagement hole 38*b*1. Accordingly, when the engagement protrusion 78*b* is mating with the engagement hole 38*b*2, the pair of engagement holes 41 and the pair of engagement protrusions 61 formed according to the position of the engagement hole 28*b*2 are mating with one another to lock the sliding cassette 5 in the position where the sheet cassette 1 is in the medium size. When the engagement protrusion 78*b* is mating with the engagement hole 38*b*1, the pair of engagement holes 41 and the pair of engagement protrusions 61 formed according to the position of the engagement hole 38*b*1 are mating with one another to lock the sliding cassette 5 in the position where the sheet cassette 1 is in the large size.

Figure 9:
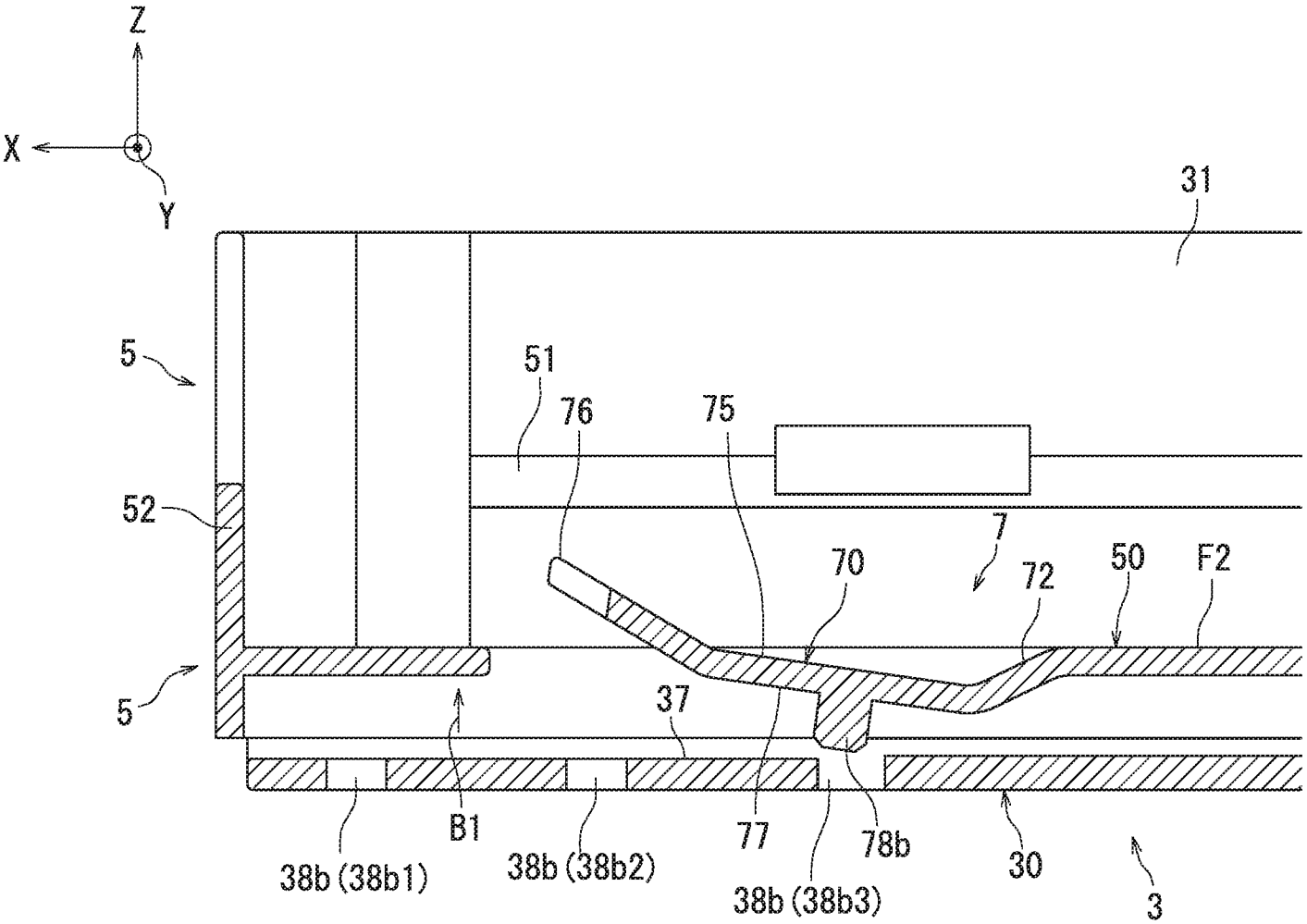
FIG. 9 is a cross-sectional view illustrating the first restricting section of the sheet cassette according to the second embodiment of the present invention (disengaged position).

Next, removal of the restriction of the sliding by releasing the engagement (releasing the mating) between one of the engagement holes 38*b* and the engagement protrusion 78*b* will be described. FIG. 9 is a cross-sectional view illustrating the disengaged state. In FIG. 9, the lever section 70 is in the disengaged position. Once external force in the upward direction B1 is exerted on the projected portion 76 of the lever section 70 in the first engaged position with the engagement protrusion 78*b* mating with one engagement hole 38*b*, the lever section 70 is shifted to the disengaged position, and thus the engagement protrusion 78*b* is pulled out of the engagement hole 38*b*, releasing the mating therebetween. Thus, the restriction of the sliding of the sliding cassette 5 is removed. That is, the sliding cassette 5 is unlocked.

When external force in the extending direction A1 is subsequently exerted on the lever section 70, the sliding cassette 5 slides in the extending direction A1. Once the lever section 70 is shifted to the first engaged position after the sliding cassette 5 has been drawn in the extending direction A1, the engagement protrusion 78*b* mates with another engagement hole 38*b*. As a result, the sliding is once again restricted, and the sliding cassette 5 is locked.

When external force in the contracting direction A2 is exerted on the lever section 70 after release of the mating, the sliding cassette 5 slides in the contracting direction A2. Once the lever section 70 is shifted to the first engaged position after the sliding cassette 5 has been pushed in the contracting direction A2, the engagement protrusion 78*b* mates with yet another engagement hole 38*b*. As a result, the sliding is once again restricted, and the sliding cassette 5 is locked.

A user for example extends or contracts the size of the sheet cassette 1 according to the following procedure. The user puts a finger in the through hole 74, catches the projected portion 76 of the lever section 70 with the finger, and pulls up the projected portion 76. As a result, the lever section 70 is shifted to the disengaged position, the mating between the engagement protrusion 78*b* and one engagement hole 38*b* is released, and the restriction of the sliding is removed. Subsequently to the removal of the restriction of the sliding, the user catches the rear-side opening edge of the through hole 74 with a finger and pulls the finger in the extending direction A1 or pushes the projected portion 76 of the lever section 70 in the contracting direction A2. As a result, the sliding cassette 5 is drawn out or pushed in. The user subsequently causes the engagement protrusion 78*b* to mate with another engagement hole 38*b*, thereby locking the sliding cassette 5 and extending or contracting the size of the sheet cassette 1.

According to the second embodiment, it is possible to adjust the size of the sheet cassette 1 by simple manipulation and restrict release of the locked state of the main cassette 3 and the sliding cassette 5 after loading of the sheets P as described above with reference to FIGS. 1, 2, and 7 to 9. The second embodiment further produces the following effect in addition to the same effect as produced by the first embodiment.

That is, according to the second embodiment, the engagement holes 38*b* are formed by processing the main cassette 3, and the lever section 70 and the engagement protrusion 78*b* can be formed integrally with the sliding cassette 5 as described with reference to FIG. 7. It is therefore possible to form a mechanism for unlocking the sliding cassette 5 with a reduced number of elements.

Furthermore, the second embodiment includes a plurality of engagement holes 38*b*. The plurality of engagement holes 38*b* are arranged along the extending direction A1. Thus, the sheet cassette 1 is adjustable to a plurality of different sizes.

Furthermore, according to the second embodiment, the engagement protrusion 78*b* and the engagement holes 38*b* allow the locking and the unlocking of the sliding cassette 5 to be readily performed.

Third Embodiment

The sheet cassette 1 according to the third embodiment of the present invention will be described with reference to FIGS. 1, 2, and 10. Configuration of the sheet cassette 1 according to the third embodiment is the same as the configuration of the sheet cassette 1 according to the first embodiment except a part of the first restricting section 7. Therefore, the sheet cassette 1 illustrated in FIGS. 1 and 2 will be described as the sheet cassette 1 according to the third embodiment. Hereinafter, a difference between the third embodiment and the first embodiment will be mainly described.

Figure 10A:
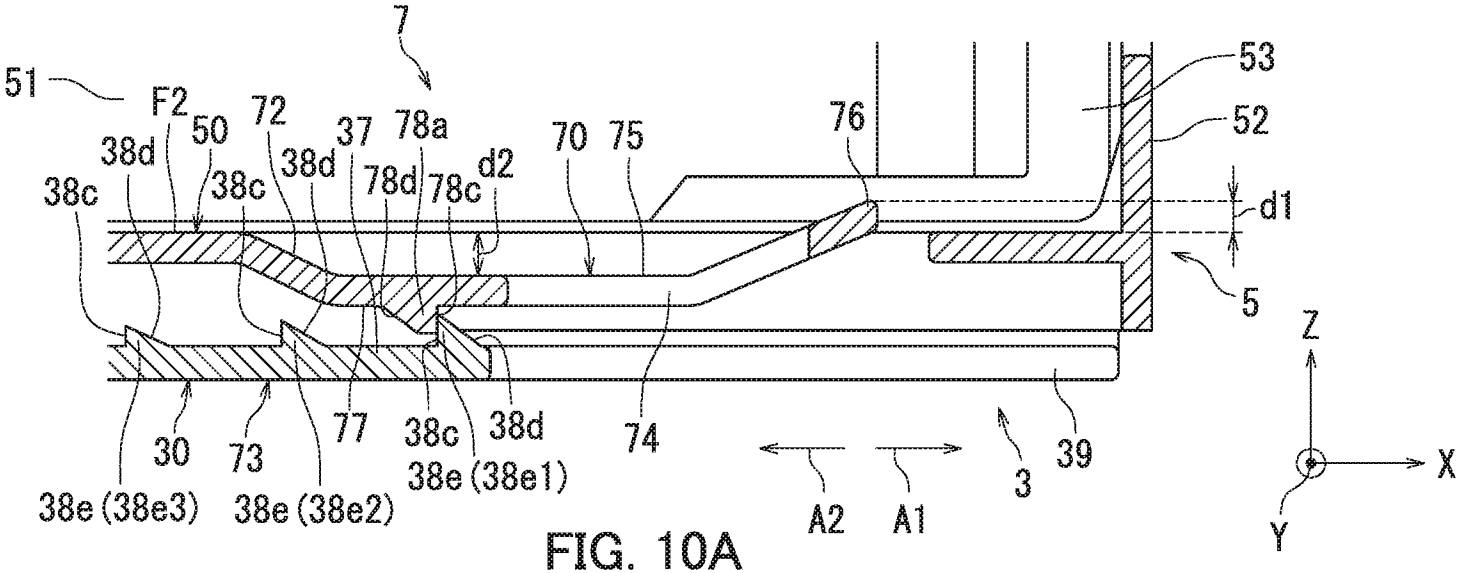
FIG. 10A is a cross-sectional view illustrating a first restricting section of a sheet cassette according to a third embodiment of the present invention.

FIG. 10A is a cross-sectional view illustrating the engaged state of the first restricting section 7 (restricting section). FIG. 10A illustrates the lever section 70 in the first engaged position.

In the third embodiment, a plurality of engagement pawls 38*e* (a plurality of first engagement sections) are provided instead of the engagement pawl 38*a* (see FIG. 3) of the first embodiment. Furthermore, the main cassette 3 includes a rack 73. The rack 73 is disposed in the bottom member 30 of the main cassette 3 and is movable relative to the main cassette 3 in a sliding direction of the sliding cassette 5. The sliding direction is the extending direction A1 or the contracting direction A2. The rack 73 has the plurality of engagement pawls 38*e* arranged in the sliding direction of the sliding cassette 5. As described above, an engagement structure that is engageable with the mating engagement pawl 78*a* is formed from the rack 73 having the plurality of engagement pawls 38*e* arranged in the sliding direction. The rack 73 has the first opposed region 37 that is opposed to the lever section 70 according to the position of the lever section 70. The engagement pawls 38*e* are formed in the first opposed region 37.

Figure 10B:
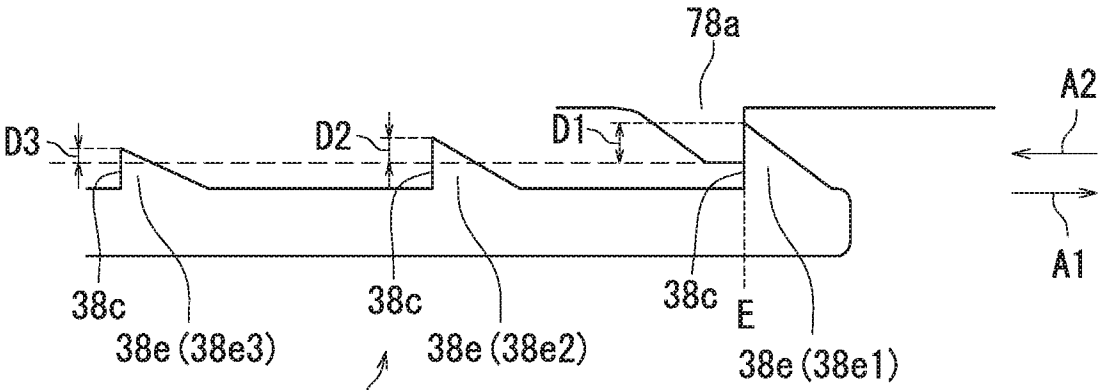
FIG. 10B is a schematic view illustrating a rack of the first restricting section of the sheet cassette according to the third embodiment of the present invention.

FIG. 10B is a schematic view illustrating the rack 73. Each engagement pawl 38*e* has a different length from a peak thereof to a peak of the mating engagement pawl 78*a* (hereinafter, referred to as an "engagement length") when the lever section 70 is in the first engaged position. In the third embodiment, the plurality of engagement pawls 38*e* have protrusion amounts that increase stepwise in the extending direction A1. Detailed description thereof will be given below.

In the third embodiment, engagement pawls 38*e*1 to 38*e*3 are provided as the plurality of engagement pawls 38*e*. Of engagement lengths D1 to D3, the engagement length D1 of the engagement pawl 38*e*1 is the longest, the engagement length D3 of the engagement pawl 38*e*3 is the shortest, and the engagement length D2 of the engagement pawl 38*e*2 is between the engagement length D1 and the engagement length D3.

The longer the engagement length of an engagement pawl 38*e* is, the stronger the engagement between the engagement pawl 38*e* and the mating engagement pawl 78*a* is, and the tighter the locking of the sliding cassette 5 is. By contrast, the shorter the engagement length of an engagement pawl 38*e* is, the looser the locking of the sliding cassette 5 is, but the more operable the sliding cassette 5 is. That is, the easier unlocking and sliding the sliding cassette 5 is.

The rack 73 is secured to the bottom member 30 with an engagement surface 38*c* of one of the engagement pawls 38*e*1 to 38*e*3 at an engagement location E. In the third embodiment, therefore, a user can adjust the tightness of the locking of the sliding cassette 5 and the operability of the sliding cassette 5 to different degrees according to usage conditions by moving the rack 73.

In a situation in which the sheet cassette 1 is used frequently by being filled with sheets P having a maximum size, for example, the user adjusts the position of the rack 73 so that the locking is tight. For example, the rack 73 is fixed so that the engagement pawl 38*e*1 is at the engagement location E. On the other hand, in a situation in which the sheet cassette 1 is used less frequently by being filled with sheets P having a maximum size, for example, the user adjusts the position of the rack 73 so that the locking is loose, giving priority to the operability. For example, the rack 73 is fixed so that the engagement pawl 38*e*3 is at the engagement location E.

Since the third embodiment has the same lever section 70 as the first embodiment, it is possible to adjust the size of the sheet cassette 1 by simple manipulation and restrict release of the locked state of the main cassette 3 and the sliding cassette 5 after loading of the sheets P.

In the third embodiment, the first engaged position is a position where while the sliding cassette 5 is in the retracted position, no sheets are loaded on the bottom member 50, the projected portion 76 protrudes from the sheet loading surface F2 of the bottom member 50, and one engagement pawl 38*e* and the mating engagement pawl 78*a* are in engagement. The second engaged position is a position where while the sliding cassette 5 is in the retracted position, the projected portion 76 is pushed down out of the first engaged position in accordance with the number of sheets loaded on the bottom member 50, and the engagement pawl 38*e* and the mating engagement pawl 78*a* are in engagement. The disengaged position is a position where while the sliding cassette 5 is in the retracted position, the lever section 70 is lifted out of the first engaged position, and thus the engagement between the engagement pawl 38*e* and the mating engagement pawl 78*a* is released.

Fourth Embodiment

Figure 11:
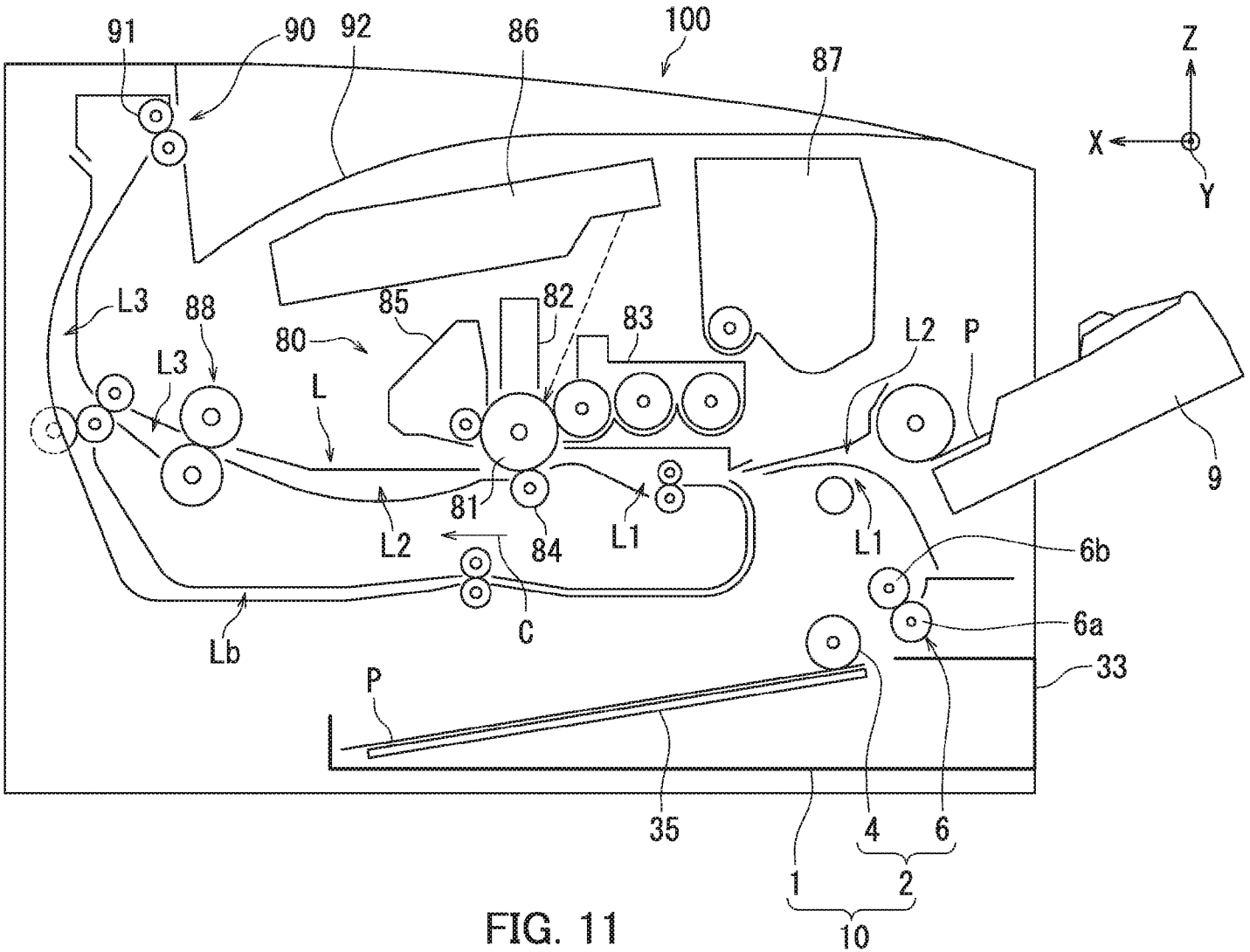
FIG. 11 is a schematic cross-sectional view for illustrating an overview of an image forming apparatus according to a fourth embodiment of the present invention.

An image forming apparatus 100 in the fourth embodiment of the present invention will be described with reference to FIG. 11. FIG. 11 is a schematic cross-sectional view for illustrating an overview of the image forming apparatus 100. The image forming apparatus 100 is for example a copier, a printer, or a multifunction peripheral. A multifunction peripheral for example has at least two of a copier, a printer, and a facsimile machine. Hereinafter, an example in which the image forming apparatus 100 is a printer will be described.

The image forming apparatus 100 includes a feeder 10, an image forming section 80, and a discharge section 90. The image forming apparatus 100 also has a conveyance path L. The conveyance path L includes conveyance paths L1 to L3 and a conveyance path Lb.

The feeder 10 includes the sheet cassette 1, a feeding section 2, and a manual feed tray 9. The sheet cassette 1 is the sheet cassette 1 according to the first embodiment (see FIG. 3), the sheet cassette 1 according to the second embodiment (see FIG. 7), or the sheet cassette 1 according to the third embodiment (see FIG. 10). The sheet cassette 1 is disposed in a lower part of the image forming apparatus 100. The sheet cassette 1 is drawable from a front surface of the image forming apparatus 100 in a negative direction of the X axis along the X axis. The panel 33 of the sheet cassette 1 forms a portion of the front surface of the image forming apparatus 100.

The feeding section 2 feeds the sheets P loaded in the sheet cassette 1. More specifically, the feeding section 2 includes a pickup roller 4 and a pair of feeding rollers 6. The pair of feeding rollers 6 include a retard roller 6*a* and a feed roller 6*b*. The pickup roller 4 feeds the sheets P loaded in the sheet cassette 1 to the pair of feeding rollers 6 while rotating.

The pair of feeding rollers 6 prevent multiple feeding of sheets P and feed the sheets P to the conveyance path L1 one sheet at a time. More specifically, the feed roller 6*b* feeds the sheets P while rotating. When receiving one sheet P, the retard roller 6*a* is driven to rotate by the feed roller 6*b*. When receiving a plurality of sheets P stuck on one another, on the contrary, the retard roller 6*a* rotates in a direction opposite to a direction for feeding the sheets P or stops to separate a sheet P in contact with the feed roller 6*b* from another sheet P. As a result, one sheet P is fed by the feed roller 6*b*. The sheet P is conveyed to the image forming section 80 along the conveyance path L1. Sheets P are also loaded on the manual feed tray 9. The sheets P are fed from the manual feed tray 9 to the conveyance path L2 and further fed to the conveyance path L1. The sheets P are conveyed to the image forming section 80 along the conveyance path L1.

The image forming section 80 forms an image on a sheet P fed by the feeder 10. More specifically, the image forming section 80 includes a photosensitive drum 81, a charger 82, a development section 83, a transfer section 84, a cleaning section 85, a light exposure section 86, a toner cartridge 87, and a fixing section 88.

The photosensitive drum 81 rotates in a direction along a conveyance direction C of the sheets P. The charger 82 charges a surface of the photosensitive drum 81. The light exposure section 86 irradiates the surface of the photosensitive drum 81 with light based on image data. As a result, an electrostatic latent image based on the image data is formed on the surface of the photosensitive drum 81. The development section 83 attaches toner to the electrostatic latent image to form a toner image on the surface of the photosensitive drum 81. The toner cartridge 87 contains the toner and supplies the toner to the development section 83.

The transfer section 84 presses the sheet P against the surface of the photosensitive drum 81 to transfer the toner image onto the sheet P. The sheet P having the toner image transferred thereon is conveyed to the fixing section 88 along the conveyance path L2. The fixing section 88 applies heat and pressure to the sheet P to fix the toner image on the sheet P. The sheet P on which the toner image has been fixed by the fixing section 88 is conveyed to the discharge section 90 along the conveyance path L3. The cleaning section 85 removes toner left on the surface of the photosensitive drum 81.

The discharge section 90 includes a pair of discharge rollers 91 and an exit tray 92. The pair of discharge rollers 91 discharge the sheet P conveyed thereto along the conveyance path L3 to the exit tray 92. When duplex printing is to be performed, the sheet P conveyed to the conveyance path L3 is returned into the conveyance path L1 along the conveyance path Lb. The sheet P is for example plain paper, recycled paper, thin paper, thick paper, or an overhead projector (OHP) sheet.

As described above, the image forming apparatus 100 according to the fourth embodiment includes the sheet cassette 1 according to the first embodiment, the sheet cassette 1 according to the second embodiment, or the sheet cassette 1 according to the third embodiment. It is therefore possible to adjust the size of the sheet cassette 1 by simple manipulation and restrict release of the locked state of the main cassette 3 and the sliding cassette 5 after loading of the sheets P. Other than that, the third embodiment produces the same effects as the first embodiment, the second embodiment, and the third embodiment.

The embodiments of the present invention have been described so far with reference to FIGS. 1 to 11. However, the present invention is not limited to the above-described embodiments and can be practiced in various ways within the scope without departing from the essence of the present invention. For example, the following alterations may be made.

(1) The first embodiment includes a single engagement pawl 38*a*. Alternatively, a plurality of engagement pawls 38*a* may be formed. In this case, the plurality of engagement pawls 38*a* are arranged parallel to the extending direction A1 as in the case of the plurality of engagement holes 38*b* according to the second embodiment. Thus, the sheet cassette 1 is adjustable to a plurality of different sizes. Furthermore, the second embodiment may have a single engagement hole 38*b*.

(2) The engagement between the engagement pawl 38*a* and the mating engagement pawl 78*a* is released, the engagement between one engagement hole 38*b* and the engagement protrusion 78*b* is released, or the engagement between one engagement pawl 38*e* and the mating engagement pawl 78*a* is released by pulling up the lever section 70 in the upward direction B1 in the first embodiment to the third embodiment. Alternatively, a configuration in which the engagement is released by pushing down the lever section 70 in the downward direction B2 may be employed.

(3) A plurality of protrusions may be formed instead of the plurality of engagement holes 38*b*, and an engagement hole may be formed instead of the engagement protrusion 78*b* in the second embodiment.

(4) The cutout portion 39 is formed in the bottom member 30 of the main cassette 3 in the first embodiment to the third embodiment. Alternatively, the main cassette 3 may have a through hole instead of the cutout portion 39. More specifically, the through hole is formed in the bottom member 30 corresponding to the region of movement of the through hole 74 in accompaniment to the sliding of the sliding cassette 5. A user can therefore slide the sliding cassette 5 without pulling their finger out of the through hole 74.

(5) The projected portion 76 is projected in a diagonal upward direction from the lower portion 75 toward the extending direction A1 in the first embodiment to the third embodiment. Alternatively, the projected portion 76 may be projected in a diagonal upward direction from the lower portion 75 toward the contracting direction A2 or projected in a vertical upward direction from the lower portion 75.

(6) The rack 73 is movable relative to the main cassette 3 in the sliding direction of the sliding cassette 5 in the third embodiment. Alternatively, the rack 73 may be fixed to the bottom member 30 so as to be non-movable relative to the main cassette 3. Accordingly, the lever section 70 is disposed in the sliding cassette 5 so as to be movable relative to the sliding cassette 5 in the sliding direction of the sliding cassette 5. As a result, it is possible to adjust the tightness of the locking of the sliding cassette 5 and the operability of the sliding cassette 5 to different degrees according to usage conditions as in the third embodiment.

(7) The lever section 70 is formed from an elastic material or formed so as to have elasticity in the first embodiment to the third embodiment. The lever section 70 may be formed as a separate member from the sliding cassette 5 and connected with the bottom member 50. Examples of elastic materials include synthetic resins and metals. Examples of the lever section 70 formed so as to have elasticity include a plate spring.

(8) The sheet conveyance direction in the sheet cassette 1 is substantially the same as the contracting direction A2 in the first embodiment to the fourth embodiment. Alternatively, the sheet conveyance direction may be different from the contracting direction A2. For example, the sheet conveyance direction may be substantially perpendicular to the contracting direction A2.

INDUSTRIAL APPLICABILITY

The present invention is applicable to the fields of sheet cassettes in which a plurality of sheets are loaded, and of feeders and image forming apparatuses including the sheet cassettes.

The invention claimed is:

1. A sheet cassette configured to be loaded with a plurality of sheets and to be adjustable in size, the sheet cassette comprising:

a first sheet accommodation section having a first bottom on which the plurality of sheets are loaded;

a second sheet accommodation section having a second bottom on which the plurality of sheets are loaded, the second sheet accommodation section being configured to be attached to the first sheet accommodation section so as to be slidable between a retracted position where the second sheet accommodation section is retracted in the first sheet accommodation section and an extended position where the second sheet accommodation section is drawn out from the first sheet accommodation section in an extending direction; and a restricting section configured to restrict sliding of the second sheet accommodation section in the retracted position, wherein the restricting section includes:

a lever section extending from the second bottom in the extending direction and having a distal end portion in the extending direction that is swingable in upward and downward directions;

a first engagement section disposed in the first bottom; and a second engagement section disposed in the lever section and configured to be engageable with the first engagement section, the lever section is shiftable between a first engaged position, a second engaged position, and a disengaged position while the second sheet accommodation section is in the retracted position, the first engaged position being a position where no sheets are loaded on the second bottom, the distal end portion protrudes from a sheet loading surface of the second bottom, and the first engagement section and the second engagement section are in engagement, the second engaged position being a position where the distal end portion is pushed down out of the first engaged position in accordance with a number of sheets loaded on the second bottom, and the first engagement section and the second engagement section are in engagement, the disengaged position being a position where the lever section is lifted out of the first engaged position, and thus the engagement between the first engagement section and the second engagement section is released, and strength of the engagement between the first engagement section and the second engagement section is larger when the lever section is in the second engaged position than when the lever section is in the first engaged position.

2. The sheet cassette according to claim 1, wherein the second sheet accommodation section is slidable to the extended position as a result of the lever section being pulled in the extending direction when the lever section is in the disengaged position.

3. The sheet cassette according to claim 1, wherein the first engagement section is an engagement pawl protruding from the first bottom, and the second engagement section is a mating engagement pawl protruding from the lever section.

4. The sheet cassette according to claim 1, wherein the first engagement section is an engagement hole formed in the first bottom, and the second engagement section is an engagement protrusion protruding from the lever section and configured to mate with the engagement hole.

5. The sheet cassette according to claim 1, wherein the lever section has a through hole located on a side of the distal end portion and configured to be caught by a finger, and the first bottom of the first sheet accommodation section has a cutout portion elongated in the extending direction and corresponding to a region of movement of the through hole in accompaniment to the sliding of the second sheet accommodation section.

6. The sheet cassette according to claim 1, wherein the first engagement section comprises a plurality of first engagement sections arranged in the extending direction.

7. The sheet cassette according to claim 6, wherein the plurality of first engagement sections have protrusion amounts increasing stepwise in the extending direction.

8. The sheet cassette according to claim 6, wherein the plurality of first engagement sections are a plurality of engagement pawls, and the plurality of engagement pawls are arranged in the extending direction to form a rack and the rack constitutes an engagement structure engageable with the second engagement section.

9. A feeder comprising:

the sheet cassette according to claim 1; and a feeding section configured to feed a sheet from the sheet cassette.

10. An image forming apparatus comprising:

the feeder according to claim 9; and an image forming section configured to form an image on the sheet fed by the feeder.

* * * * *